US005229788A

United States Patent [19]

Shimada et al.

[11] Patent Number: 5,229,788

[45] Date of Patent: Jul. 20, 1993

[54] THERMAL LINE PRINTER WITH STAGGERED HEAD SEGMENTS

[75] Inventors: Seishi Shimada; Mitsuhiro Kaiya, both of Tokyo, Japan

[73] Assignee: Seiko Instruments Inc., Japan

[21] Appl. No.: 407,404

[22] Filed: Sep. 14, 1989

[51] Int. Cl.[5] ..... B41J 2/32

[52] U.S. Cl. ..... 346/76 PH; 400/120; 400/82

[58] Field of Search ..... 346/76 PH; 400/120, 400/82

[56] References Cited

U.S. PATENT DOCUMENTS

| | | | |
|---|---|---|---|
| 4,342,040 | 7/1982 | Fujita et al. | 346/76 PH |
| 4,385,302 | 5/1983 | Moriguchi et al. | 346/76 PH |
| 4,660,052 | 4/1987 | Kaiya et al. | 346/76 PH |

FOREIGN PATENT DOCUMENTS

| | | | |
|---|---|---|---|
| 0114863 | 6/1986 | Japan | 346/76 PH |
| 0141571 | 6/1986 | Japan | 346/76 PH |
| 0202856 | 9/1986 | Japan | 346/76 PH |
| 0166428 | 10/1988 | Japan . | |

*Primary Examiner*—Benjamin R. Fuller
*Assistant Examiner*—Huan Tran
*Attorney, Agent, or Firm*—Bruce L. Adams; Van C. Wilks

[57] ABSTRACT

A thermal head device operates while a recording medium is fed in its lengthwise direction for line-sequentially printing each image line along its widthwise direction. A platen has a plane tangential thereto to define a level of feeding pass of the recording medium in a printing zone thereof. A plurality of planar head segments are opposed to the printing zone of the platen in staggered relation to each other such that the head segments are arranged along a pair of parallel rows along the widthwise direction of the recording medium. The respective planar head segments have edge portions opposed to each other between the parallel rows in the printing zone, and are slanted relative to the tangential plane such that the respective edge portions are inclined away from the feeding pass of the recording medium.

9 Claims, 3 Drawing Sheets

THERMAL LINE PRINTER WITH STAGGERED HEAD SEGMENTS

BACKGROUND OF THE INVENTION

The present invention relates to a thermal line printer of the type having a line head composed of a plurality of linear thermal head segments aligned in the widthwise direction of a recording medium sheet perpendicular to the feeding direction or the lengthwise direction of the recording medium sheet so as to cover the entire span or width of the recording medium sheet.

One type of conventional divided line head is composed of a plurality of linear thermal head segments aligned in a single row and coupled to each other at opposed ends of adjacent segments. Each linear segment has a given length sufficient to cover the span of A4 or B4 size recording paper and is formed with a plurality of heating elements arranged linearly on the segment at a given pitch. These linear head segments are connected in series to each other to constitute the divided line head which can cover the entire span of larger size recording paper such as A1 size and A0 size, and which has a higher yield rate than that of a monolithic line head of comparative length.

However, this type of conventional divided line head has the drawback that the pitch of heating elements is made irregular at the junction or connecting portion of adjacent segments to thereby degradate the quality of printed image pattern.

Another type of conventional divided line head is disclosed in U.S. Pat. No. 4,660,052. This conventional head is composed of a plurality of linear thermal head segments aligned in a pair of parallel rows in staggered relation and in partially overlapping relation at end portions of the linear segments between the parallel rows so as to completely cover the entire width or span of recording paper. In operation, the first row of linear segments is activated to effect a part of single line printing, and then the second row of linear segments is shifted in the lengthwise direction of the recording paper relative thereto through an interval corresponding to the distance between the parallel rows and is activated to effect the remaining part of the single line printing to thereby complete the single line printing.

FIG. 1 is a side view of the conventional staggered thermal printing head device. As shown in the figure, the first row of head segments 1*a* and 1*c* are opposed to a corresponding first platen 2A, and the second row of head segments 1*b* and 1*d* are opposed to a corresponding second platen 2*b*. The major surfaces of the planar head segments 1*a*, 1*b*, 1*c* and 1*d* in contact with a recording paper 3 are aligned in parallel to a common plane tangential to the pair of platens 2*a* and 2*b*. An edge portion of the head segments may block a feeding pass of the recording paper transferred along the common tangential plane between the head segments and platen due to slight difference between the levels of the head segments and due to error in set angles of the head segments relative to the common tangential plane.

FIG. 2 is a partial side view of a thermal printing head segment. The head segment 1*a* is formed at is edge portion with electrically resistive heating elements 6 as well as common electrodes 4 for supplying driving current to the heating elements and a protective film layer 5, these of which are raised upwardly relative to the heating elements 6. The raised or convex portion tends to protrude into the feeding pass of the recording paper to thereby disturb the linearity of pass between the pair of the parallel platens 2*a* and 2*b*. Therefore, a dot line part printed by the downstream or succeeding thermal head segments 1*a* and 1*c* is not aligned or matched with the remaining dot line part printed by the upstream or preceding thermal head segments 1*b* and 1*d*. As a result, the conventional staggered printing head device cannot print a perfect dot line because of disturbance or distortion of recording paper pass.

SUMMARY OF THE INVENTION

In view of the above noted drawback in the prior art, an object of the present invention is to arrange the head segments so as to eliminate disturbance or distortion of the straight feeding pass of the recording paper. The planar head segments are slanted at their raised portions relative to the feeding pass to escape from the feeding pass. By slanting the head segments, the raised or edge portion thereof can be positioned away from the pass of recording paper so as to eliminate distortion of the recording paper pass, which would otherwise be caused due to relative variation of the surface level of the head segments and relative variation of the set position and angle, thereby avoiding vertical dislocation of the printed image and mechanical damage on the recording paper.

DETAILED DESCRIPTION OF PREFERRED EMBODIMENTS

Figure 1:
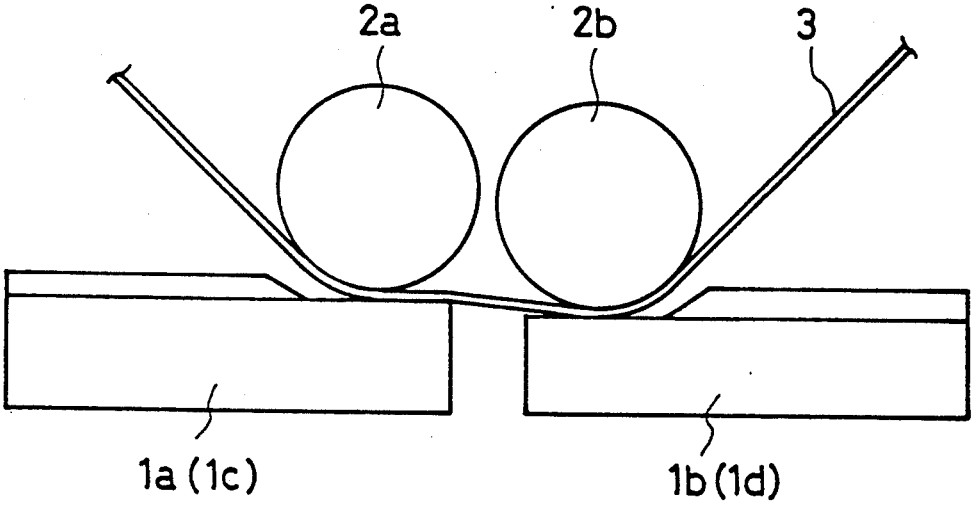
FIG. 1 PRIOR ART
FIG. 1 is a side view of the conventional line thermal head device.
Figure 2:
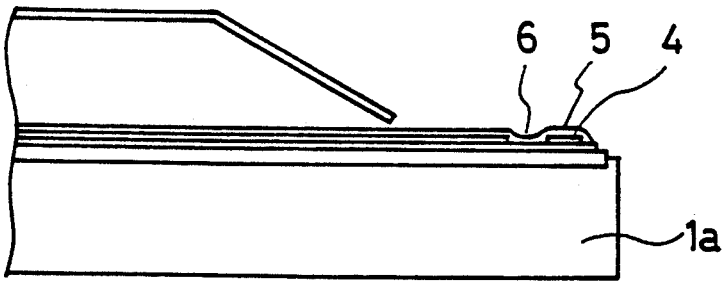
FIG. 2 PRIOR ART
FIG. 2 is a partial side view of the conventional head segment.
Figure 3A:
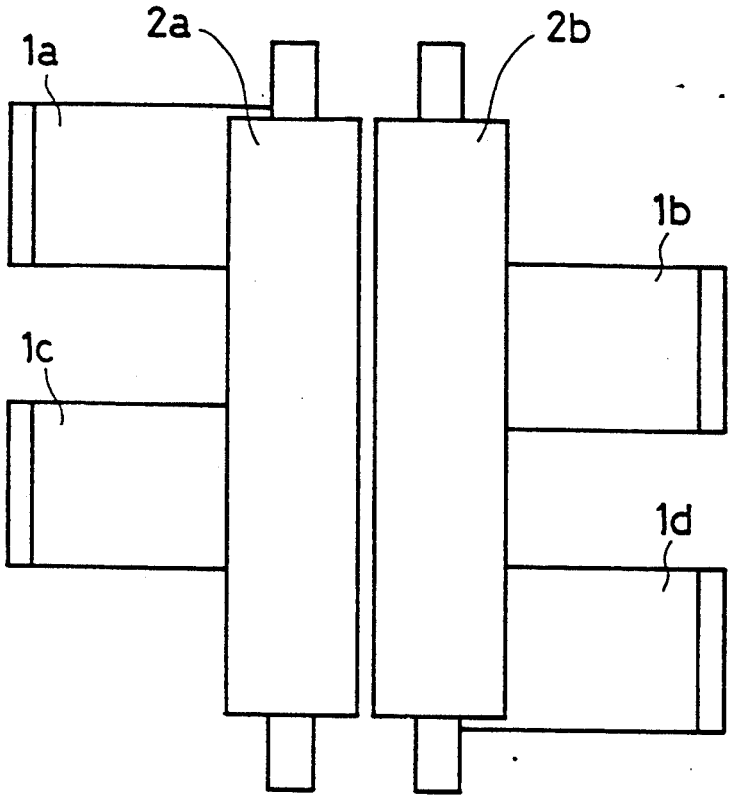
FIG. 3A is a schematic plan view of one embodiment of the line thermal head device according to the present invention.
Figure 3B:
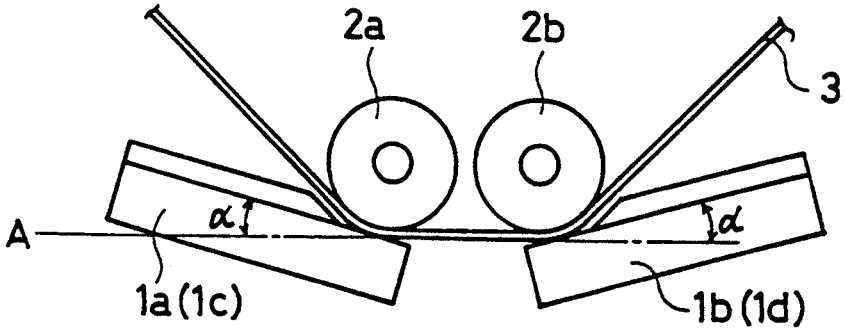
FIG. 3B is a side view of the FIG. 3A embodiment.

FIG. 3A is a plan view of one embodiment and FIG. 3B is a partial side view of the same embodiment. As shown in the figures, the line thermal head device is comprised of a pair of platen rollers 2*a* and 2*b* disposed in parallel to each other. A plurality of planar head segments 1*a*, 1*b*, 1*c* and 1*d* are disposed in contact with the platen rollers in staggered relation such that the first pair of head segments 1*a* and 1*c* are arranged in a row along the first platen roller 2*a* and the second pair of head segments 1*b* and 1*d* are arranged in a row along the second platen roller 2*b*. By such arrangement, the plurality of head segments 1*a* through 1*d* can be operatively coupled in series to each other in the widthwise direction of a recording paper so as to cover substantially the entire span of the recording paper which is longer than that of each individual head segment. The first pair of thermal head segments 1*a* and 1*c* have heating elements, at their edge portion, aligned linearly along the platen roller 2*a* in contact therewith, and the second pair of head segments 1*b* and 1*d* have heating elements, at their edge portion, aligned linearly along the second platen roller 2*b* in contact therewith.

Further as shown in FIG. 3B, the major surface of respective head segments 1*a* through 1*d* is slanted or inclined relative to a common plane A tangential to the parallel platen rollers 2*a* and 2*b* in a printing zone such that the edge or peripheral portion of the respective head segments is disposed away from the surface of the recording medium 3. Namely, the major surface of the respective head segments and the common plane A intersect with each other at an angle $\alpha$ such that the first pair of head segments 1*a* and 1*c* and the second pair of head segments 1*b* and 1*d* accommodate therebetween the platen rollers. When the slanting angle $\alpha$ is set less than 2°, the setting error of the head segments and the level difference between the head segments cannot be effectively absorbed so that the raised portion formed at the edge area of respective head segments may protrude into the pass of the recording paper 3. On the other hand, when the slanting angle $\alpha$ is set more than 8°, the lengthwise distance of the recording paper feeding pass is increased between the parallel rows of head segments, thereby decreasing the absolute accuracy of the lengthwise distance therebetween to cause vertical image dislocation. Moreover, since the winding angle of the recording paper 3 is increased relative to the platen rollers 2*a* and 2*b*, the variation of diameter of each individual platen roller and the nip of the platen roller (indentation of rubber platen surface produced by pressing of the thermal head) may cause a serious affect to generate dislocation of printed image. Thus, as a result of experiment, the slanting angle $\alpha$ of the respective head segments should be set in the optimum range from 2° to 8°.

Figure 4:
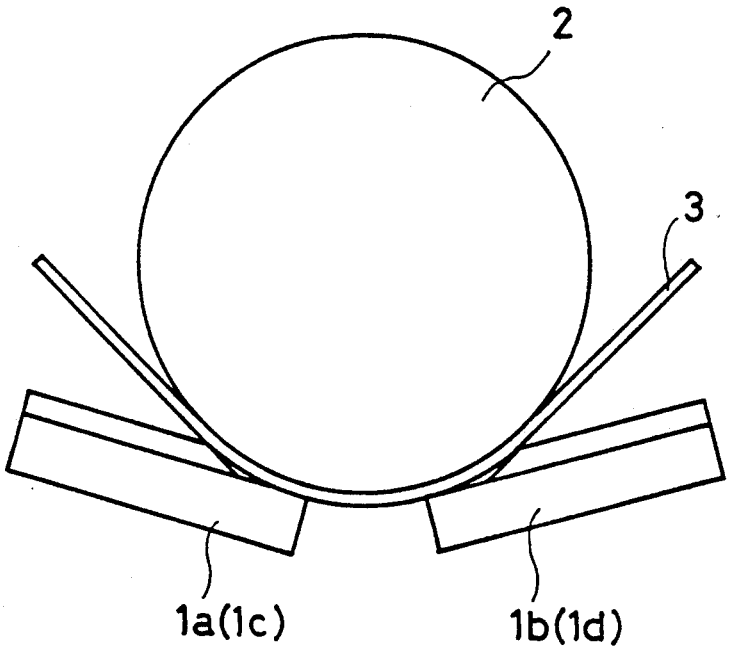
FIG. 4 is a side view of another embodiment of the line thermal head device according to the present invention.

FIG. 4 shows another embodiment of the line thermal head device for line-sequentially printing image dot lines in the widthwise direction of a recording paper while feeding the recording paper in the lengthwise direction thereof. The head device is comprised of a single platen roller 2, and a plurality of head segments 1*a* through 1*d* arranged in staggered relation relative to each other in a manner similar to the FIG. 3A embodiment such that the recording paper 3 is interposed in contact between the platen roller 2 and the head segments 1*a* through 1*d*. The major surface of respective head segments is slanted relative to a plane tangential to the platen roller and defining a level of a feeding pass in the printing zone such that the edge portions of respective head segments opposed between a pair of rows of staggered arrangements are inclined away from the surface of recording paper 3.

As described above, in this embodiment, the thermal head segments are disposed in slanted relation to the tangential plane so as to eliminate the affect of level variation of head segments and error in the setting angle thereof to thereby reduce the image dislocation recorded by the plurality of thermal head segments arranged in staggered relation.

What is claimed is:

1. A thermal head device operative while a recording medium is fed in a lengthwise direction for line-sequentially printing each image line along a widthwise direction of the recording medium, the device comprising:

a pair of platen rollers disposed in spaced-apart relation in a feeding direction of the recording medium and having a plane tangential commonly to both platen rollers to define a level of a feeding pass of the recording medium in a printing zone thereof; and a plurality of planar head segments opposed to the pair of platen rollers and arranged in staggered relation to each other along a pair of parallel rows along the widthwise direction of the recording medium, the respective planar head segments having edge portions opposed to each other between the parallel rows and being slanted relative to the tangential plane such tht the respective edge portions are inclined away from the feeding pass of the recording medium.

2. A thermal head device according to claim 1; wherein the respective planar head segments have a slanting angle relative to the tangential plane in the range from 2° to 8°.

3. An apparatus for recording on a recording medium, comprising: a pair of platens disposed in spaced-apart relation in a direction of lengthwise advancement of a recording medium, each of the platens having a curved surface over which the recording medium advances lengthwise during use of the apparatus, and the pair of platens lying in a common plane tangential commonly to the curved surface of both platens to define a level of a feeding pass of the recording medium as the recording medium advances from one of said platens to the other of said platens; and a plurality of thermal heads arranged in two parallel rows which extend in a widthwise direction of the recording medium, the thermal heads in each of the rows being disposed in opposed relation to the curved surface of a different one of the platens with the recording medium in between, the thermal heads in one row being staggered in the widthwise direction relative to the thermal heads in the other row to enable the thermal heads in both rows to jointly effect sequential line recording on the recording medium as the recording medium advances lengthwise from said one of said platens to the other over, the curved surfaces of the pair of platens, and the thermal heads in both rows being inclined relative to the common plane toward one another in a direction away from the pair of platens to facilitate lengthwise advancement of the recording medium past the thermal heads.

4. An apparatus according to claim 3; wherein the thermal heads in each row are inclined at an angle in the range from 2° to 8° relative to the common plane.

5. An apparatus according to claim 3; wherein the thermal heads each have a generally planar portion and heating elements in the region of the planar portion, the thermal heads in each row being inclined such that the planar portions thereof are inclined at an angle in the range from 2° to 8° relative to the common plane.

6. An apparatus according to claim 3; wherein the platens comprise cylindrical platens.

7. An apparatus according to claim 3; wherein the platens comprise platen rollers.

8. An apparatus according to claim 3; wherein the angle of inclination of the thermal heads is effective to reduce dislocation of the image recorded by the thermal heads on the recording medium.

9. An apparatus according to claim 8; wherein the angle of inclination of each thermal head is in the range 2° to 8°.

* * * * *